US007591542B2

(12) United States Patent
Sugahara

(10) Patent No.: US 7,591,542 B2
(45) Date of Patent: Sep. 22, 2009

(54) PIEZOELECTRIC ACTUATOR, METHOD FOR PRODUCING THE SAME AND INK-JET HEAD

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 404 days.

(21) Appl. No.: 11/143,753

(22) Filed: Jun. 3, 2005

(65) Prior Publication Data

US 2006/0066684 A1 Mar. 30, 2006

(30) Foreign Application Priority Data

Jun. 3, 2004 (JP) ..... 2004-166162

(51) Int. Cl.
*B41J 2/045* (2006.01)

(52) U.S. Cl. ..... 347/68; 347/71

(58) Field of Classification Search ..... 347/70–72, 347/4

See application file for complete search history.

(56) References Cited

U.S. PATENT DOCUMENTS

| | | | | |
|---|---|---|---|---|
| 4,523,121 | A | 6/1985 | Takahashi et al. | |
| 6,467,886 | B1 | 10/2002 | Takao et al. | |
| 6,809,459 | B2 | 10/2004 | Ikeda et al. | |
| 6,992,421 | B2 | 1/2006 | Ikeda et al. | |
| 7,226,151 | B2 * | 6/2007 | Murai | 347/71 |
| 7,336,020 | B2 | 2/2008 | Ikeda et al. | |
| 2004/0060969 | A1 * | 4/2004 | Imai et al. | 228/180.21 |
| 2005/0035688 | A1 | 2/2005 | Namerikawa et al. | |

FOREIGN PATENT DOCUMENTS

| | | | |
|---|---|---|---|
| JP | 58-196076 | A | 11/1983 |
| JP | 2-035785 | A | 2/1990 |
| JP | 3-064979 | A | 3/1991 |
| JP | 7-30165 | A | 1/1995 |
| JP | 2003-188431 | A | 4/2003 |
| JP | 2003154646 | | 5/2003 |
| JP | 2003-258328 | A | 9/2003 |
| WO | WO 0119614 | | 3/2001 |
| WO | 03-061023 | A1 | 7/2003 |

OTHER PUBLICATIONS

Article: Zirconia, ZrO2-Zirconium, Azom.com; www.piceramic.de:piezoceramic materials; efunda: General Information on Iridium.*

Notification of Reasons for Rejection mailed May 26, 2009 in Japanese Application No. 2005-162712 and English translation thereof.

* cited by examiner

*Primary Examiner*—Matthew Luu
*Assistant Examiner*—Lisa M Solomon
(74) *Attorney, Agent, or Firm*—Banner & Witcoff, Ltd.

(57) ABSTRACT

A method of manufacturing a piezoelectric actuator includes a first step of providing, on an insulating layer, a first electrode which has a recess formed on a surface of the first electrode; a second step of forming a piezoelectric layer on the surface of the first electrode; and a third step of forming a second electrode on a surface of the piezoelectric layer. Since a part of the piezoelectric layer enters into the recess, the piezoelectric layer is constrained by the first electrode. Therefore, the piezoelectric layer hardly exfoliates from the first electrode, and the adhesion between the piezoelectric layer and the first electrode is improved. Consequently, the durability of the piezoelectric actuator is improved.

12 Claims, 13 Drawing Sheets

PIEZOELECTRIC ACTUATOR, METHOD FOR PRODUCING THE SAME AND INK-JET HEAD

BACKGROUND OF THE INVENTION

1. Field of the Invention

The present invention relates to a method of manufacturing piezoelectric actuator, a piezoelectric actuator, and an ink-jet head which includes the piezoelectric actuator.

2. Description of the Related Art

A piezoelectric actuator which drives an object by deforming a piezoelectric layer by an action of an electric field on the piezoelectric layer has been hitherto known. An actuator disclosed in Japanese Patent Application Laid-open Publication No. 2003-154646 (FIG. 3) which is used in an ink-jet recording apparatus is one of such type. The piezoelectric actuator according to this patent document includes a piezoelectric layer which is formed by lead zirconate titanate (PZT), a plurality of lower electrodes which are provided on an under surface of the piezoelectric layer to correspond to a plurality of pressure chambers, respectively of an ink-jet head, and a plurality of upper electrodes which are provided on a top surface of the piezoelectric layer to correspond to a plurality of pressure chambers respectively. When drive voltage is supplied to the piezoelectric actuator, there is a difference in electric potential of the lower electrode and that of the upper electrode. Due to the difference in the electric potentials, the electric field acts on the piezoelectric layer which is sandwiched between the two electrodes, thereby deforming the piezoelectric layer, and pressure is applied to ink in the pressure chambers via the lower electrodes which also serves as a vibration plate.

This piezoelectric actuator is manufactured as described below. To start with, the upper electrode is formed on an MgO (magnesium oxide) single crystal substrate by sputtering method. Then, a layer of PZT is formed on a surface of the upper electrode by the sputtering method and the piezoelectric layer is formed by performing a heat treatment on the PZT layer. Furthermore, the lower electrode is formed on the surface of the piezoelectric layer by using the sputter method.

However, in the piezoelectric actuator disclosed in this patent document, there is a substantial difference in a coefficient of thermal expansion between a conductive material of the electrode and PZT of the piezoelectric layer which is in contact with the electrode. As a result, there is a substantial difference in amount of deformation between the PZT and the electrode during a process of forming the piezoelectric layer by means of a heat treatment of PZT. Therefore, interface stress between the piezoelectric layer and the electrode increases, so that the piezoelectric layer tends to exfoliate easily from the electrode. This results in deterioration of durability of the piezoelectric actuator and there is a decline in the yield at the manufacturing stage.

SUMMARY OF THE INVENTION

An object of the present invention is to provide a method of manufacturing piezoelectric actuator and a piezoelectric actuator capable of improving an adhesion between the piezoelectric layer and the electrode.

According to a first aspect of the present invention, there is provided a method of manufacturing a piezoelectric actuator comprising:

a first step of providing, on an insulating layer, a first electrode which has a recess formed on a surface of the first electrode;

a second step of forming a piezoelectric layer on the surface of the first electrode; and a third step of forming a second electrode on a surface of the piezoelectric layer. In this method, the recess may be formed as a through hole which penetrates the first electrode. The through hole may include a plurality of holes. Moreover, in the first step, an electrode may be formed on the surface of the insulating layer and a plurality of through holes which penetrate the electrode may be formed.

According to the method of manufacturing piezoelectric actuator, since a part of the piezoelectric layer enters into the recess or the through hole and the piezoelectric layer is formed with recesses and projections in an interface between the first electrode and the piezoelectric layer, the piezoelectric layer is constrained by a plurality of recesses or through holes. Therefore, the piezoelectric layer hardly exfoliates from the surface of the first electrode, thereby improving the adhesion between the piezoelectric layer and the first electrode. Consequently, there is an improvement in durability of the piezoelectric actuator and a better yield during the manufacturing stage.

Moreover, when the piezoelectric layer is formed of a material which requires heat treatment such as lead zirconate titanate (PZT) or the like, there is a difference in an amount of deformation during the heat treatment due to a difference in coefficient of thermal expansion between the material forming the piezoelectric layer and a material forming the first electrode, which results in generating an interface stress between the first electrode and the piezoelectric layer. When the interface stress is high, the piezoelectric layer tends to easily exfoliate from the first electrode. However, when the recess is a through hole, a contact surface between the first electrode and the piezoelectric layer is fragmented in places by the through hole. This lowers the interface stress between the first electrode and the piezoelectric layer, and even in a case where the heat treatment is performed on such piezoelectric layer, there is an improvement in the adhesion between the piezoelectric layer and the first electrode.

In the method of manufacturing according to the present invention, the insulating layer may be formed of a material which has a coefficient of thermal expansion closer to a coefficient of thermal expansion of the piezoelectric layer than to a coefficient of thermal expansion of the first electrode. Even when the piezoelectric layer is formed of a material which requires heat treatment such as the lead zirconate titanate (PZT), the coefficient of thermal expansion of the insulating layer is closer to that of the piezoelectric layer than to that of the first electrode. Accordingly, when the heat treatment is performed on the piezoelectric layer, the difference in the amount of deformation between the piezoelectric layer and the insulating layer is smaller than the difference in the amount of deformation between the piezoelectric layer and the first electrode. Therefore, when the recess is a through hole, the piezoelectric layer is adhered easily to the insulating layer and by adhering of the piezoelectric layer partially to the insulating layer via the plurality of through holes formed on the first electrode, the adhesion of the piezoelectric layer and the first electrode is further improved.

In the method of manufacturing according to the present invention, a diameter of the through hole may be greater than a thickness of the first electrode. Therefore, the piezoelectric layer is adhered easily to the insulating layer through the through hole and the adhesion of the piezoelectric layer and the first electrode is improved.

In the method of manufacturing according to the present invention, the diameter of the through hole may be smaller than the thickness of the piezoelectric layer. Accordingly, it is possible to minimize the decline in deformation efficiency of the piezoelectric layer which would be otherwise caused by a disturbance in an electric field applied to the piezoelectric layer due to the presence of through holes.

In the method of manufacturing according to the present invention, when the through hole includes a plurality of holes and the holes are respectively formed in a central portion and an outer peripheral portion of the first electrode, a density of allocation of the holes in the outer peripheral portion of the first electrode may be greater than a density of allocation of the holes in the central portion of the first electrode. At the interface between the piezoelectric layer and the first electrode, as the position is nearer to the outer peripheral portion of the first electrode, the interface stress becomes greater, and thus the piezoelectric layer tends to easily exfoliate from the outer peripheral portion. However, by making the density of allocation of the holes in the outer peripheral portion greater than that in the central portion, the adhesion in the outer peripheral portion can be improved. Because of this, the piezoelectric level hardly exfoliates from the first electrode.

In the method of manufacturing according to the present invention, in the first step, a wire which extends from the first electrode and which applies a drive voltage to the first electrode may be formed. A plurality of through holes may be formed in this wire. Thus, by forming the plurality of through holes also in the wire which extends from the first electrode, it is possible to improve the adhesion between the first electrode, the wire, and the piezoelectric layer.

In the method of manufacturing according to the present invention, in the second step, the piezoelectric layer may be formed by any one of aerosol deposition method, sputtering method, CVD (Chemical Vapor Deposition) method, and sol-gel method. When the piezoelectric layer is formed by these methods, particles of the material which forms the piezoelectric layer can enter easily into the through holes. Therefore, the piezoelectric layer can be adhered partially to the insulating layer via the through holes and the adhesion of the piezoelectric layer and the first electrode is thus improved.

The method of manufacturing according to the present invention may further comprise forming the insulating layer on a metallic vibration plate formed of metal. This enables to form the vibration plate of a metallic material which has a high elasticity and to improve the response of the piezoelectric actuator. Furthermore, the insulating layer enables to electrically insulate the metallic vibration plate and the first electrode.

According to a second aspect of the present invention, there is provided a piezoelectric actuator comprising:

an insulating layer;

a first electrode which has a recess formed on a surface of the first electrode and which is provided on the insulating layer;

a piezoelectric layer which is formed on the surface of the first electrode; and a second electrode which is formed on a surface of the piezoelectric layer. The recess may be formed as a through hole which penetrates the first electrode. The through hole may include a plurality of holes. In this piezoelectric actuator, the piezoelectric layer enters into the recess such as the through hole, the piezoelectric layer with recesses and projections is formed in the interface between the first electrode and the piezoelectric layer, and the piezoelectric layer is constrained by a recess such as the through hole. Therefore, the piezoelectric layer hardly exfoliates from the surface of the first electrode, thereby improving the adhesion between the piezoelectric layer and the first electrode. Consequently, the durability of the piezoelectric actuator can be improved and a better yield during the manufacturing stage can be realized.

In the piezoelectric actuator according to the present invention, when the insulating layer is formed of a material which has a coefficient of thermal expansion closer to a coefficient of thermal expansion of the piezoelectric layer than to a coefficient of thermal expansion of the first electrode and when the recess is a through hole, the piezoelectric layer may be tightly and partially adhered to the insulating layer via one or the plurality of through holes. Even when the piezoelectric layer is formed of the material which requires heat treatment such as the lead zirconate titanate (PZT), the coefficient of thermal expansion of the insulating layer is closer to that of the piezoelectric layer than to that of the first electrode. Accordingly, when the heat treatment is performed on the piezoelectric layer, the difference in the amount of deformation between the piezoelectric layer and the insulating layer is smaller than the difference in the amount of deformation between the piezoelectric layer and the first electrode. Therefore, the piezoelectric layer is adhered easily to the insulating layer. In addition, by adhering the piezoelectric layer partially to the insulating layer via one or the plurality of through holes which are formed on the first electrode, the adhesion of the piezoelectric layer and the first electrode is improved.

According to a third aspect of the present invention, there is provided an ink-jet head comprising:

nozzles which discharge ink;

a channel unit which has a plurality of pressure chambers communicating with the nozzles, respectively; and a piezoelectric actuator which selectively changes a volume of the plurality of pressure chambers, wherein the piezoelectric actuator includes:

an insulating layer;

a plurality of individual electrodes provided on the insulating layer corresponding to the pressure chambers respectively, each of the individual electrodes being formed with a recess provided on a surface thereof;

a piezoelectric layer provided on surfaces of the plurality of individual electrodes; and a common electrode provided on the piezoelectric layer. The recess may be a through hole which penetrates each of the individual electrodes. The through hole may include a plurality of holes.

In the ink-jet head according to the present invention, when a drive voltage is supplied selectively to the plurality of individual electrodes of the piezoelectric actuator, an electric field is generated in the piezoelectric layer between the individual electrode and the common electrode to deform the piezoelectric layer. Due to the deformation of the piezoelectric layer, the pressure is applied to the ink in the pressure chamber and the ink is discharged from the nozzle. In this case, in the piezoelectric actuator, since one or a plurality of recesses such as a through hole is provided on each of the individual electrodes, the piezoelectric layer hardly exfoliates from the individual electrode and the adhesion between the individual electrode and the piezoelectric layer is improved.

In the ink-jet head according to the present invention, the insulating layer may be formed of a material which has a coefficient of thermal expansion closer to a coefficient of thermal expansion of the piezoelectric layer than to a coefficient of thermal expansion of the individual electrodes, and when the recess is a through hole, the piezoelectric layer may be tightly and partially adhered to the insulating layer via the through hole. Therefore, since the piezoelectric layer is tightly adhered to the insulating layer via the through holes, the adhesion of the piezoelectric layer and the individual electrode is improved.

DETAILED DESCRIPTION OF THE PREFERRED EMBODIMENTS

Exemplary embodiments of the present invention are described below. The present embodiment is an example in which the present invention is applied to a piezoelectric actuator which is used in an ink-jet head.

Figure 1:
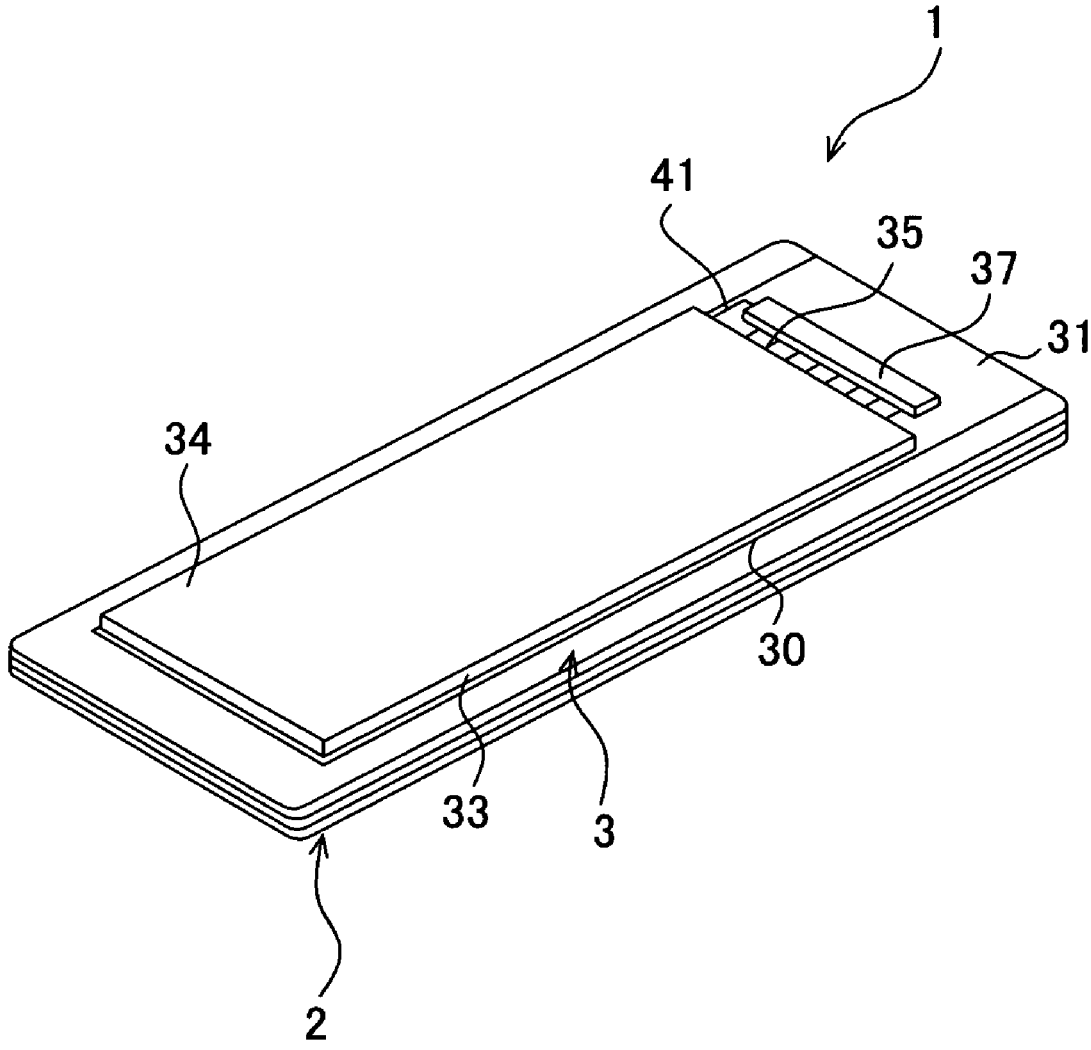
FIG. 1 is a perspective view of an ink-jet head according to an embodiment of the present invention.

As shown in FIG. 1, an ink-jet head 1 includes a channel unit 2 which has an ink channel formed therein, and a piezoelectric actuator 3 which is laminated on an upper surface of this channel unit 2.

Figure 2:
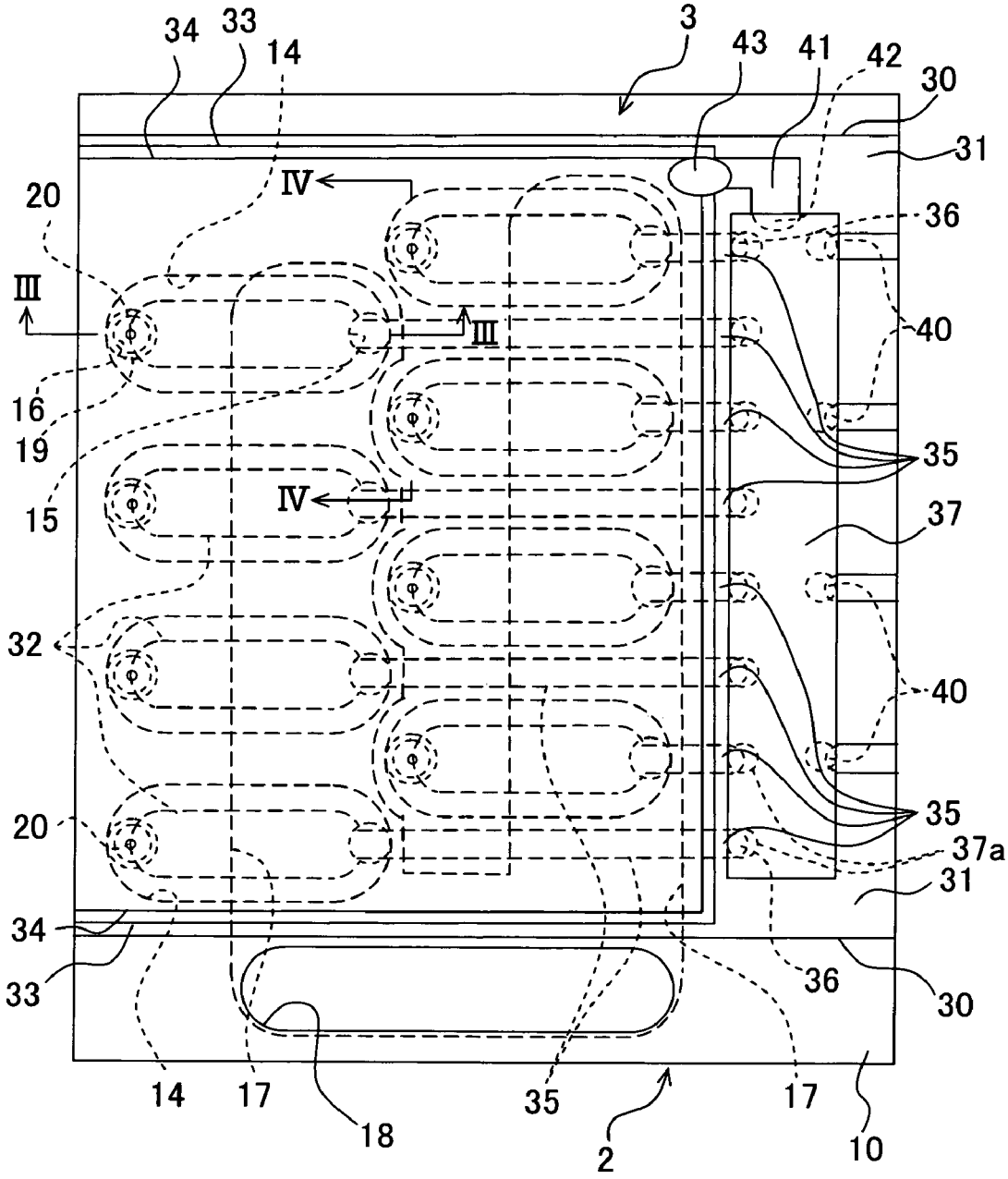
FIG. 2 is a plan view of a right half of the ink-jet head as shown in FIG. 1.
Figure 3:
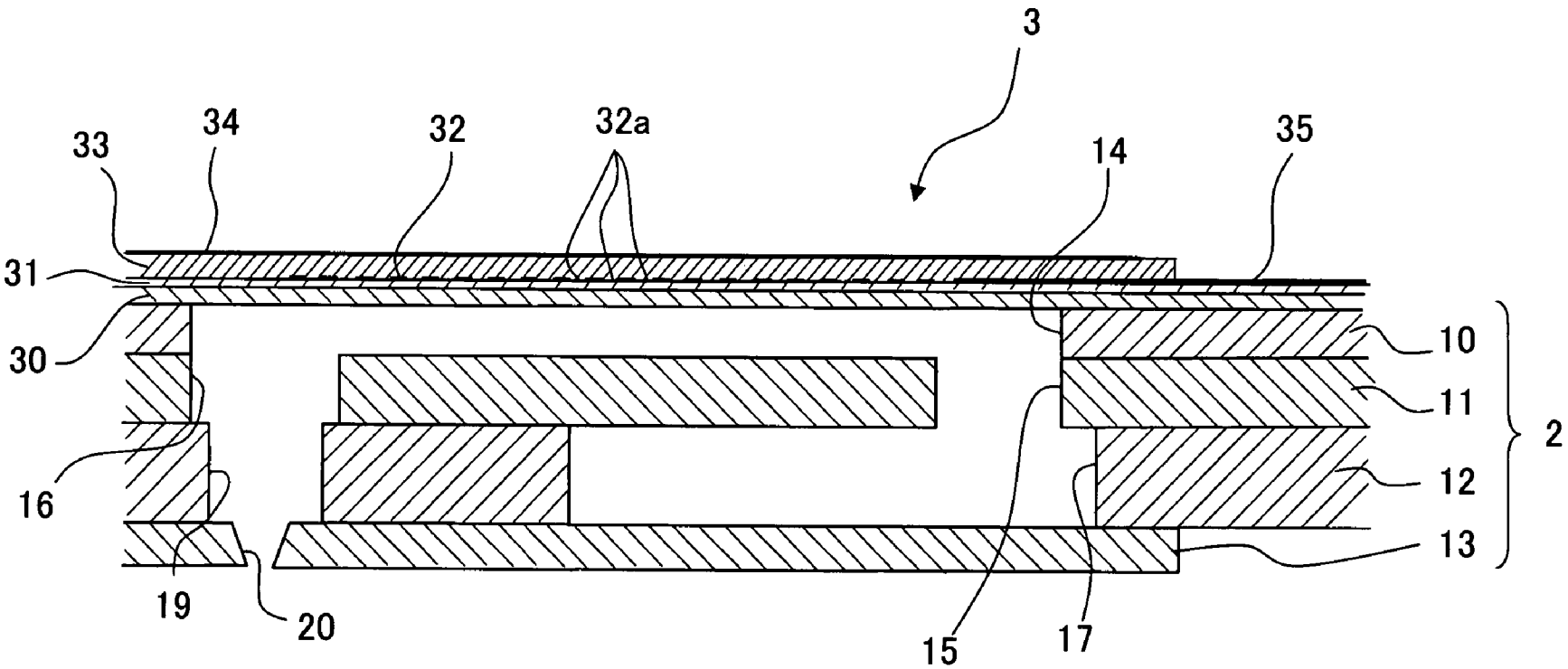
FIG. 3 is a cross-sectional view taken along a line III-III shown in FIG. 2.
Figure 4:
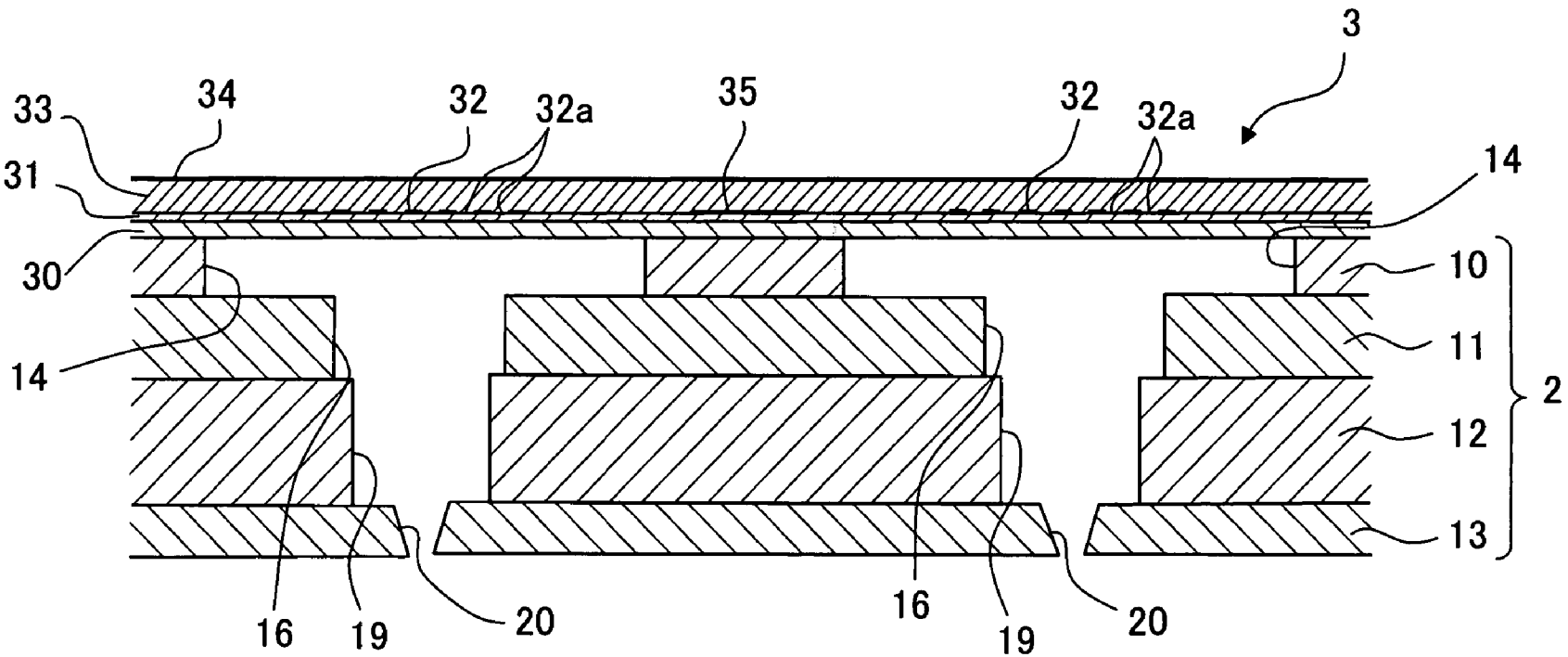
FIG. 4 is a cross-sectional view taken along a line IV-IV shown in FIG. 2.

To start with, the channel unit 2 is described below. FIG. 2 is a schematic plan view of a right half of the ink-jet head 1 shown in FIG. 1. FIG. 3 is a cross-sectional view taken along a line III-III shown in FIG. 2 and FIG. 4 is a cross-sectional view taken along a line IV-IV shown in FIG. 2. As shown in FIG. 2 to FIG. 4, the channel unit 2 includes a cavity plate 10, a base plate 11, a manifold plate 12, and a nozzle plate 13, and these four plates 10 to 13 are joined in stacked layers. Among these, the cavity plate 10, the base plate 11, and the manifold plate 12 are stainless steel plates having a substantially rectangular shape. Therefore, ink channels such as a manifold 17 and a pressure chamber 14 which will be described later, can be formed easily by etching or the like on these three plates 10 to 12. Moreover, the nozzle plate 13 is formed of a high molecular synthetic resin material such as polyimide and is joined on a lower surface of the manifold plate 12. Or, the nozzle plate 13 may be formed of a metallic material such as stainless steel, similar to the three plates 10 to 12.

As shown in FIG. 2, in the cavity plate 10 a plurality of pressure chambers 14 arranged along a plane surface is formed. These pressure chambers 14 are open in a surface (an upper surface of the cavity plate 10 to which a vibration plate 30 which will be described later is joined). FIG. 2 shows a part (eight) of the plurality of pressure chambers 14. Each pressure chamber 14 is formed substantially elliptical in a plan view and is arranged such that the long axis direction of the ellipse is parallel to the longitudinal direction of the cavity plate 10.

Communication holes 15 and 16 are formed respectively in the base plate 11 at positions which overlap in a plan view with one end of the associated chamber 14 in the long axis direction thereof. In addition, a manifold 17 which overlaps in a plan view with the right halves of the pressure chambers 14 in FIG. 2, is formed in the manifold plate 12 such that portions of the manifold 17 extend in two rows in the direction of width (vertical direction in FIG. 1) of the manifold plate 12. Ink is supplied to the manifold 17 from an ink tank (not shown) via an ink-supply port 18 which is formed in the cavity plate 10. Moreover, a communication hole 19 is formed at a position which overlaps in a plan view with a left-end portion of the pressure chamber 14 in FIG. 2. Furthermore, a plurality of nozzles 20 is formed in the nozzle plate 13 at positions which overlap in a plan view with the left-end portion of the plurality of pressure chambers 14 respectively. The nozzle 20 is formed, for example, by means of excimer laser process on a substrate of a high-molecular synthetic resin such as polyimide.

As shown in FIG. 3, the manifold 17 communicates with the pressure chamber 14 via the communication hole 15, and the pressure chambers 14 communicates with the nozzle 20 via the communication holes 16 and 19. Thus, an individual ink channel from the manifold 17 leading to the nozzle 20 via the pressure chamber 14 is formed in the channel unit 2.

Next, the piezoelectric actuator 3 will be described below. As shown in FIG. 1 to FIG. 5, the piezoelectric actuator 3 includes the vibration plate 30, an insulating layer 31, a plurality of individual electrodes 32 (first electrode), a piezoelectric layer 33, and a common electrode 34 (second electrode). The vibration plate 30 is arranged on a surface of the channel unit 2. The insulating layer 31 is formed on a surface of the vibration pate 30. The plurality of individual electrodes 32 is formed on a surface of the insulating layer 31 corresponding to the plurality of pressure chambers 14 respectively. The piezoelectric layer 33 is formed on surfaces of plurality of individual electrodes 32 so as to spread over the individual electrodes 32. The common electrode 34 is formed on a surface of the piezoelectric layer 33 and is provided in common for the plurality of individual electrodes 32.

The vibration plate 30 is a stainless steel plate having substantially rectangular shape in a plan view and is joined in a laminated state to the upper surface of the cavity plate 10 such that openings of the plurality of pressure chambers 14 are closed. Since the vibration plate 30 is formed of stainless steel which has comparatively high coefficient of elasticity, as will be described later on, when the piezoelectric layer 33 is deformed during discharge operation of the ink, the high rigidity of the vibration plate 30 makes the piezoelectric actuator 3 highly responsive. Moreover, the vibration plate 30 is joined to the surface of the cavity plate 10 which is also formed of the stainless steel material. Therefore, the coefficient of thermal expansion of the vibration plate 30 and that of the cavity plate 10 become equal, thereby improving the joining strength between the vibration plate 30 and the cavity plate 10. Furthermore, the ink in the channel unit 2 comes in contact with the channel unit 2 and the vibration plate 30 which is formed of stainless steel. Since the stainless steel is highly resistant to the corrosion by the ink, there is no likelihood that any local cells are formed in the channel unit 2 or in the vibration plate 30 regardless of the selection of ink type. Thus, since the selection of the ink is not restricted due to the corrosion related aspect, there is an increased degree of freedom of ink selection.

The insulating layer 31, which is formed of a ceramic material having a high coefficient of elasticity such as alumina, zirconia, or silicon nitride, and which surface is flat, is formed on the surface of the vibration plate 30. Because the insulating layer 31 is formed of the ceramic material which has a high coefficient of elasticity, the rigidity and the response of the actuator are improved.

Figure 5:
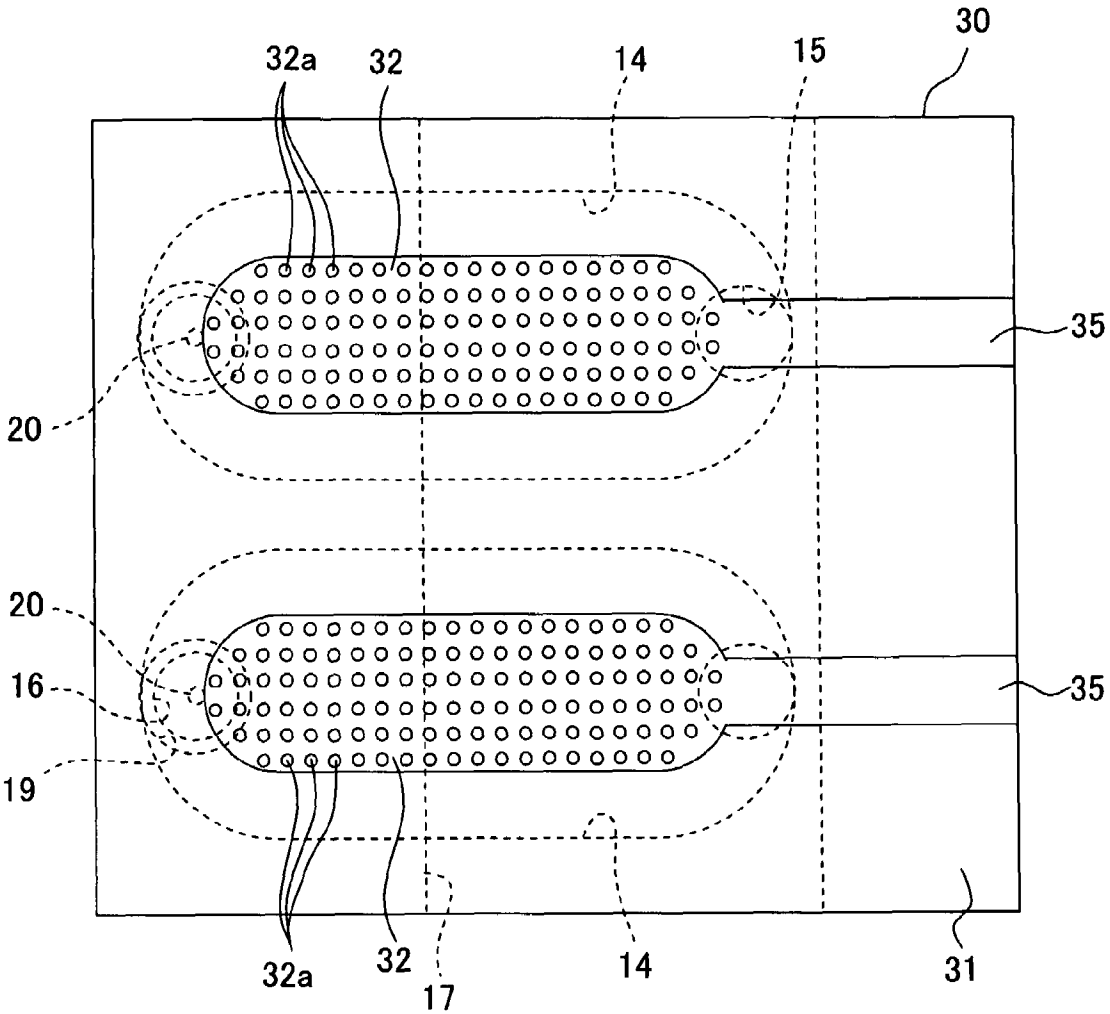
FIG. 5 is a partly enlarged view of FIG. 2.

Furthermore, the plurality of individual electrodes 32 which are elliptic, flat, and smaller in size than the pressure chamber 14 to a certain extent is formed on the surface of the insulating layer 31. Each of the individual electrodes 32 is formed at a position which overlaps in a plan view with a central portion of the corresponding pressure chamber 14. The individual electrode 32 is made of a conductive material such as gold. The adjacent individual electrode 32 is insulated electrically from each other by the insulating layer 31. Moreover, as shown in FIG. 3 to FIG. 5, a plurality of through holes 32*a* is formed in each of the individual electrodes 32. These through holes 32*a* are provided in the surface of the individual electrode 32 to improve the joining between the individual electrodes 32 and the piezoelectric layer 33 as will be described later on. The details of these through holes will be described later.

On the surface of the insulating layer 31, a plurality of wires 35 extends from one end portion (right-end portion in FIG. 2) of each of the plurality of individual electrodes 32 in parallel to a longitudinal direction of the individual electrode 32. A terminal 36 is formed at an end portion of each of the plurality of wires 35. Output terminals 37*a* of a driver IC 37, which selectively supplies drive voltage to the individual electrodes 32, are joined, via a bump (not shown) composed of a conductive brazing filler material such as solder, to the terminals 36 corresponding to the plurality of individual electrodes 32 respectively. The driver IC 37 is disposed on the surface of the insulating layer 31.

Furthermore, a plurality of connecting terminals 40 is formed on the insulating layer 31. These connecting terminals 40 and input terminals 37*b* of the driver IC 37 are joined respectively via a bump 39 made of solder or the like. The driver IC 37 and a control device (which is omitted in the drawing) which controls the driver IC 37 are connected via the connecting terminals 40.

The piezoelectric layer 33 which is principally composed of lead zirconate titanate (PZT), which is a solid solution of lead titanate and lead zirconate, and which is a ferroelectric substance, is formed on the surface of the plurality of individual electrodes 32. This piezoelectric layer 33 is formed as one continuous layer spreading over the plurality of individual electrodes 32 so as to cover the entire surfaces of the plurality of individual electrodes 32.

Figure 17A:
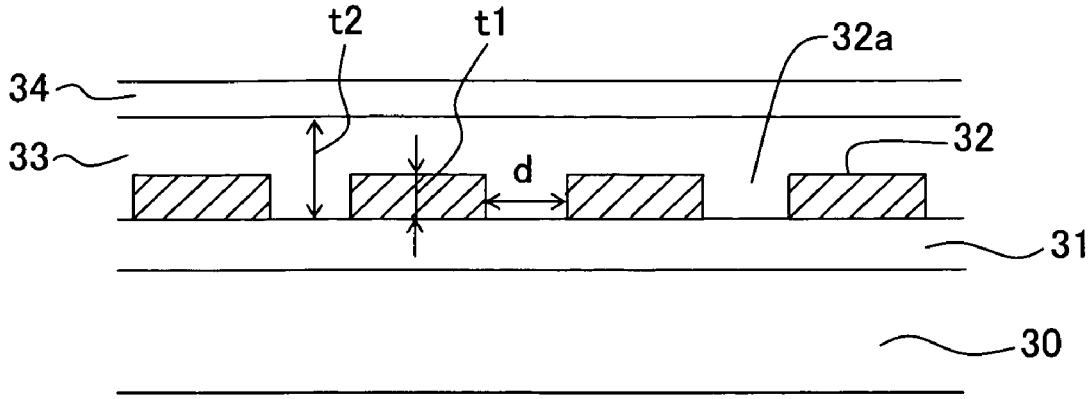
FIG. 17A is an enlarged cross-sectional view of the actuator shown in FIG. 3.

As described above, the plurality of through holes 32*a* is formed in each of the individual electrodes 32. As shown in FIG. 3, FIG. 4, and FIG. 17A, and particularly as seen in an enlarged cross-sectional view in FIG. 17A, a part of the piezoelectric layer 33 has entered into the through hole 32*a*, and the under surface of the piezoelectric layer 33 is formed with recesses and projections. Therefore, the piezoelectric layer 33 is constrained by the through holes 32*a*, and the adhesion between the individual electrode 32 and the piezoelectric layer 33 is improved. As shown in FIG. 17A, although diameter d of the through hole 32*a* is not restricted to any particular diameter, the diameter d may be greater than thickness t1 of the individual electrode 32 and may be smaller than thickness t2 of the piezoelectric layer 33. Moreover, as it is described later, the piezoelectric layer 33 formed on the surface of the individual electrode 32 is subjected to the heat treatment. In this case, while the coefficient of thermal expansion for PZT which forms the piezoelectric layer 33 is about $3\times10^{-6}$, the coefficient of thermal expansion of the conductive material such as gold, which forms the individual electrode 32, is about $14\times10^{-6}$. Therefore, after performing the heat treatment on the piezoelectric layer 33, the interface stress is developed between the individual electrode 32 and the piezoelectric layer 33 due to the difference in the amount of thermal deformation between the individual electrode 32 and PZT which forms the piezoelectric layer 33. When this interface stress is high, the piezoelectric layer 33 tends to exfoliate easily from the individual electrode 32. However, since a contact surface between the individual electrode 32 and the piezoelectric layer 33 is fragmented in places by the plurality of through holes 32*a*, the interface stress between the individual electrode 32 and the piezoelectric layer 33 is low. Therefore, the piezoelectric layer 33 hardly exfoliates from the individual electrode 32. Furthermore, the coefficient of thermal expansion of the insulating layer 31 under the individual electrode 32 such as alumina, for example, is about $7\times10^{-6}$ which is closer to the coefficient of thermal expansion of the piezoelectric layer 33 than to that of the individual electrode 32. Therefore, the piezoelectric layer 33 tends to easily adhere to the insulating layer 31 via the plurality of through holes 32*a*. Thus, by adhering the piezoelectric layer 33 partially to the insulating layer 31 via the plurality of through holes 32*a*, it is even more unlikely for the piezoelectric layer 33 to exfoliate from the individual electrode 32.

The common electrode 34 which is common to the plurality of individual electrodes 32 is formed on the surface of the piezoelectric layer 33 so as to spread over the entire surface of the piezoelectric layer 33. As shown in FIG. 2, a wire 41 extends from the common electrode 34. The wire 41 is formed to extend over the surface of the insulating layer 31 and the surface of the piezoelectric layer 33. Moreover, a terminal 42 which is provided at an end of the wire 41 is connected to a terminal (not shown) of the driver IC 37. Accordingly, the common electrode 34 is grounded via the wire 41 and the driver IC 37, and is kept at a ground potential. This common electrode 34 is also made of a conductive material such as gold.

Next, an action of the piezoelectric actuator 3 during the ink discharge is described below.

When a drive voltage is selectively supplied from the driver IC 37 to the plurality of individual electrodes 32 respectively connected to the driver IC 37 via the plurality of wires 35, the electric potential of the common electrode 34 on the piezoelectric layer 33 held at the ground potential differs from that of the individual electrode 32 under the piezoelectric layer 33 to which the drive voltage is supplied, and thus an electric field is generated in a vertical direction of the piezoelectric layer 33 sandwiched between the two electrodes 32 and 34. Apart of the piezoelectric layer 33 which is disposed directly above the individual electrode 32, to which the drive voltage is applied, contracts in a horizontal direction perpendicular to the vertical direction in which the piezoelectric layer 33 is polarized. In this case, since the vibration plate 30 and the insulating layer 31 under the piezoelectric layer 33 are fixed to the cavity plate 10, the part of the piezoelectric layer 33 sandwiched between the two electrodes 32 and 34 is deformed due to the horizontal deformation so as to project toward the associated pressure chamber 14. The partial deformation of the piezoelectric layer 33 also causes a part of the vibration plate 30 which covers the associated pressure chamber 14 to deform so as to project toward the pressure chamber 14. This leads to a decrease in volume inside the pressure chamber 14, thereby increasing the pressure of the ink, and the ink is discharged from the nozzle 20 communicating with the pressure chamber 14.

Next, a method of manufacturing piezoelectric actuator 3 will be described below.

Figure 6:
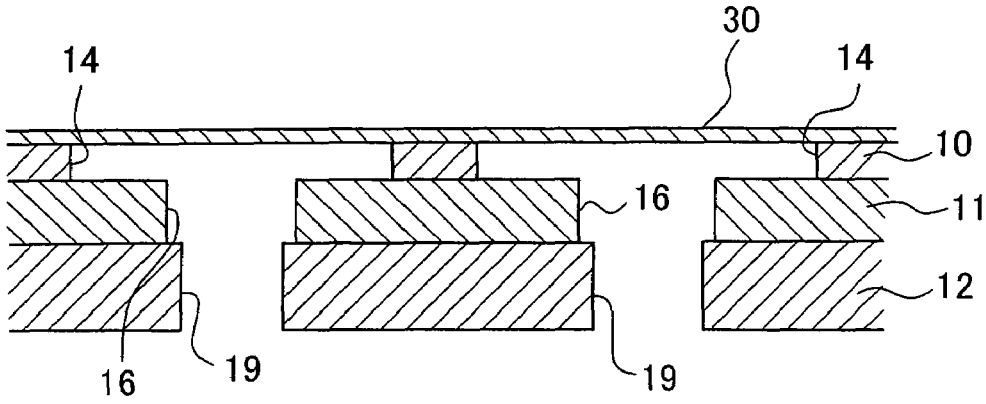
FIG. 6 is a diagram showing a step of joining a channel unit and a vibration plate.

To start with, as shown in FIG. 6, the three stainless steel plates 10 to 12 are joined to the vibration plate 30 made of stainless steel by diffusion joining or the like. The communication holes 16 and 19 are formed in advance on these plates. In this case, since the cavity plate 10 and the vibration plate 30 are both made of the stainless steel material, their coefficient of thermal expansion is the same and the residual stress at a joining surface is low. Therefore, the joining strength in these plates is extremely satisfactory.

Figure 7:
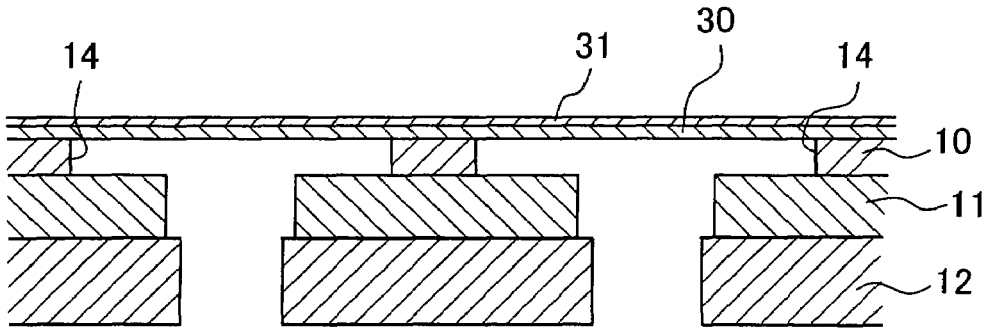
FIG. 7 is a diagram showing a step of forming an insulating layer.

Next, as shown in FIG. 7, the insulating layer 31 is formed of a ceramic material such as alumina, zirconia, or silicon nitride on the surface of the vibration plate 30. As a method for forming the insulating layer 31, aerosol deposition method may be used in which ultra fine particles are deposited by colliding the particles onto the vibration plate at a high speed, so that a very thin layer can be formed. The insulating layer 31 may also be formed by a method such as sol-gel method, sputtering method, or CVD (Chemical Vapor Deposition) method.

Figure 8:
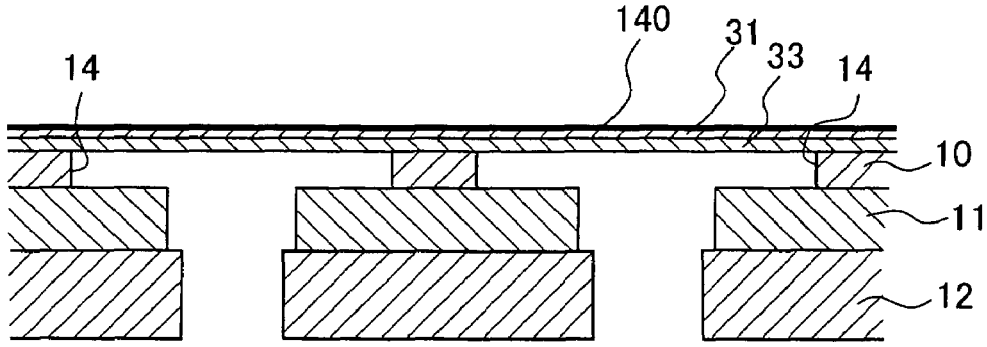
FIG. 8 is a diagram showing a step of forming an individual electrode.
Figure 9:
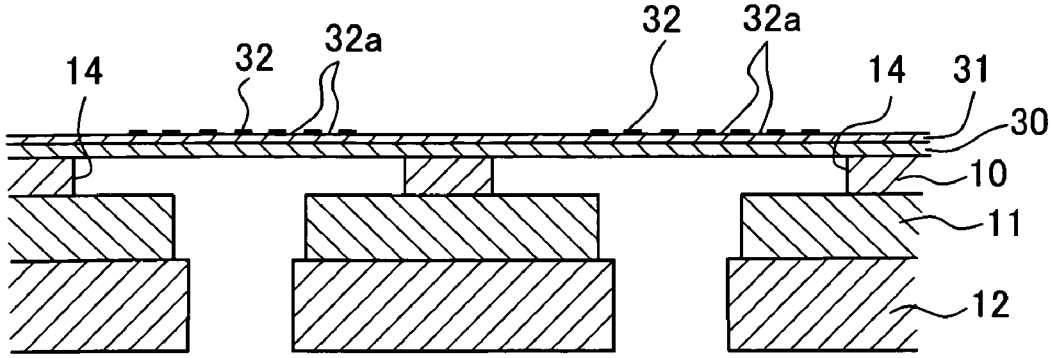
FIG. 9 is a diagram showing a step of forming a plurality of through holes.

Next, the individual electrodes 32 are formed on the surface of the insulating layer 31, and the plurality of through holes 32*a* is formed in each of the individual electrodes 32 (first step). As shown in FIG. 8, after forming a conductive layer 140 on the entire surface of the insulating layer 31 by a method such as plating method, sputtering method, or vapor deposition method, the conductive layer 140 is partially removed as shown in FIG. 9 by a method such as laser method, mask method, and resist method, thereby forming the individual electrodes 32 and the plurality of through holes 32*a*. Alternatively, the individual electrodes 32 and the plurality of through holes 32*a* may be formed at one time by screen-printing a conductive paste on the surface of the insulating layer 31. Accordingly, a first step, in the method according to the present invention, of providing, on the insulating layer, a first electrode in which the holes (recesses) are formed on the surface thereof can be carried out.

Figure 10:
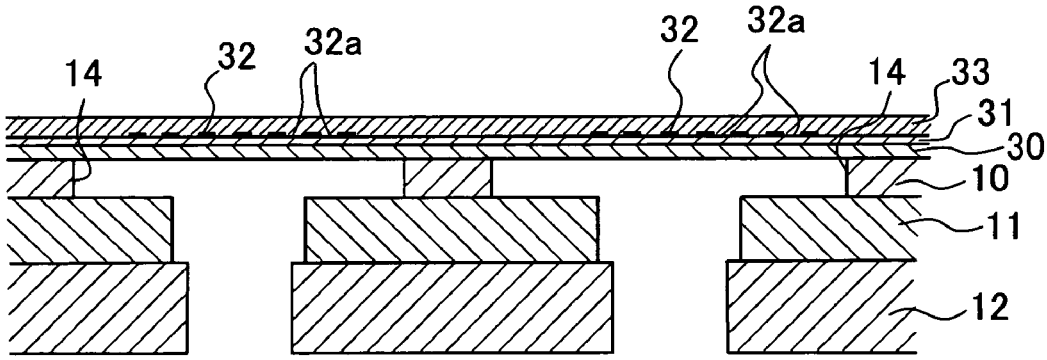
FIG. 10 is a diagram showing a step of forming a piezoelectric layer.

Next, as shown in FIG. 10, the piezoelectric layer 33 which is made of PZT is formed on the surfaces of the individual electrodes 32 by using a method such as aerosol deposition method, sol-gel method, sputtering method, or CVD method (second step). By forming the piezoelectric layer 33 by any of these methods, particles of PZT forming the piezoelectric layer 33 tend to enter easily into the plurality of through holes 32*a* formed in the individual electrode 32 and thus the piezoelectric layer 33 can easily adhere partially to the insulating layer 31 via the plurality of through holes 32*a*. Then, the heat treatment at about 600° C. is performed on the piezoelectric layer 33 to refine the structure of the piezoelectric layer 33.

Figure 11:
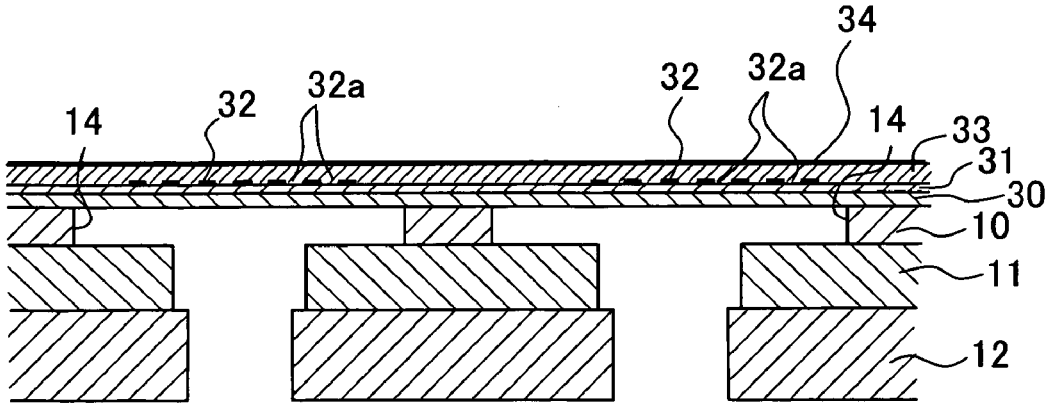
FIG. 11 is a diagram showing a step of forming a common electrode.
Figure 12:
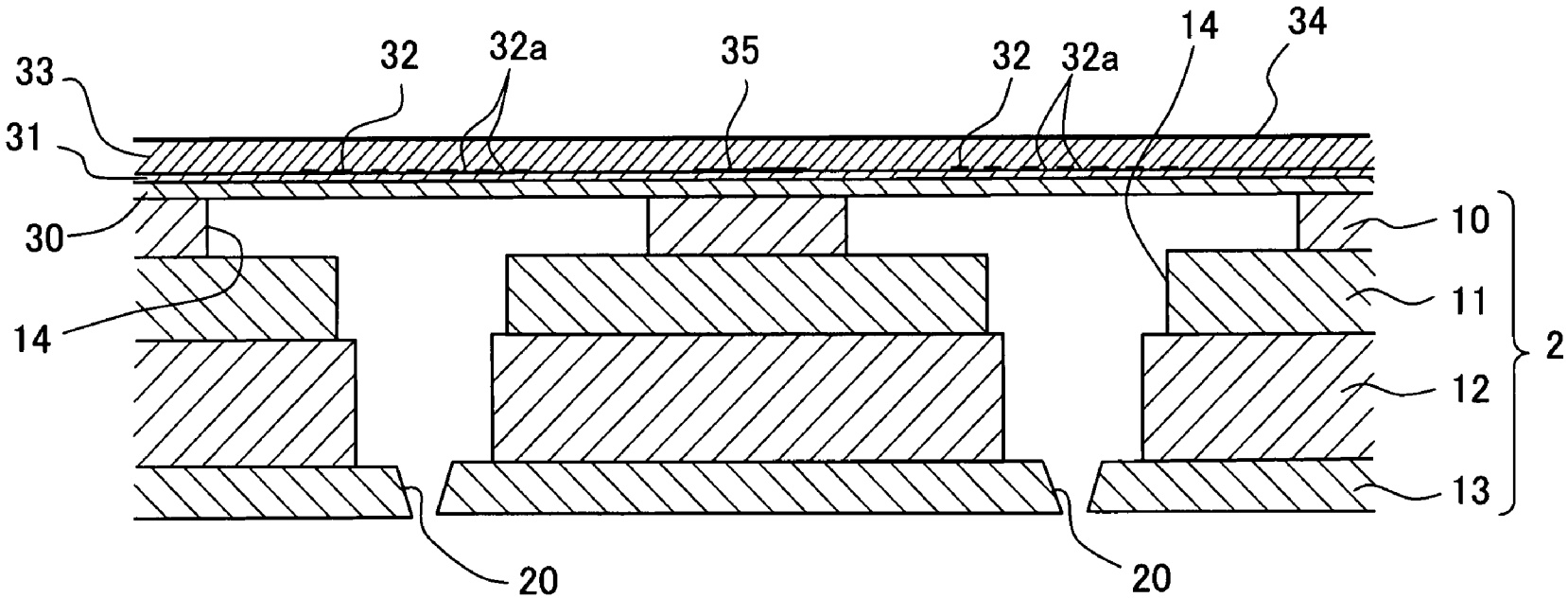
FIG. 12 is a diagram showing a step of joining a nozzle plate.

Further, as shown in FIG. 11, the common electrode 34 is formed on the entire surface of the piezoelectric layer 33 by using a method such as screen printing, vapor deposition method, or sputtering method (third step). Finally, as shown in FIG. 12, the nozzle plate 13 having the nozzles 20 formed therein in advance is joined on an under surface of the manifold plate 12.

It is desirable that the hole-diameter d of the plurality of through holes 32*a* is greater than the thickness t1 of the individual electrode 32 as shown in FIG. 17 so that the piezoelectric layer 33 easily adheres to the insulating layer 31 via the plurality of through holes 32. When the diameter of the through hole 32*a* is greater than the thickness of the individual electrode 32, the part of the piezoelectric layer 33 which is formed in one of the through holes 32*a* has a sufficient diameter with respect to the depth thereof. Therefore, there is little possibility that the part of the piezoelectric layer 33 disposed in and near to one of the through holes 32*a* is ruptured. On the other hand, when the diameter of the through holes 32*a* is too big, there is a disturbance in an electric field applied to the piezoelectric layer 33 between the individual electrode 32 and the common electrode 34. This leads to a possibility of decline in efficiency of deformation of the piezoelectric layer 33. Therefore, it is desirable that the diameter d of the through holes 32*a* is smaller than the thickness t2 of the piezoelectric layer 33 as shown in FIG. 17A. For example, when the thickness of the individual electrode 32 is about 2 μm and the thickness of the piezoelectric layer 33 is about 10 μm, it is desirable that the diameter of the plurality of through holes 32*a* is about 2 μm to 10 μm. The planar shape of the through hole is not restricted to a circular shape shown in FIG. 5 and may be any shape such as rectangular, elliptical, and slot shape.

Moreover, when the nozzle plate 13 is made of a metallic material such as stainless steel, after forming the channel unit 2 by joining in advance the nozzle plate 13 with the other three plates simultaneously, the vibration plate 30, the insulating layer 31, the individual electrode 32, and the piezoelectric layer 33 may be laminated in sequence on the surface of the channel unit 2, and the heat treatment may be performed for the piezoelectric layer 33.

According to the ink-jet head 1, the piezoelectric actuator 3, and the method of manufacturing the piezoelectric actuator 3, the following effects are achieved.

By forming the plurality of through holes 32*a* in the individual electrode 32, a part of the piezoelectric layer 33 on the surface of the individual electrode 32 enters into the through holes 32*a* and that part is constrained by the through holes 32*a*, thereby making it difficult for the piezoelectric layer 33 to exfoliate from the individual electrode 32. Moreover, since the contact surface between the individual electrode 32 and the piezoelectric layer 33 is fragmented by the plurality of through holes 32*a*, the interface stress between the individual electrode 32 and the piezoelectric layer 33 which is generated after the heat treatment of the piezoelectric layer 33 becomes low and the adhesion between the individual electrode 32 and the piezoelectric layer 33 is improved. Furthermore, since the insulating layer 31 under the individual electrode 32 has the coefficient of thermal expansion closer to that of the piezoelectric layer 33 than to that of the individual electrode 32, and since the part of the piezoelectric layer 33 which has entered into the plurality of through holes 32*a* tends to be adhered easily to the insulating layer 31, the adhesion between the individual electrode 32 and the piezoelectric layer 33 is improved further.

Next, modified embodiments in which various changes are made in the embodiment as described above are described below. Components or the like in the modified embodiments which have a structure same as those in the embodiment are assigned the same reference numerals and their description is omitted.

First Modified Embodiment

Figure 13:
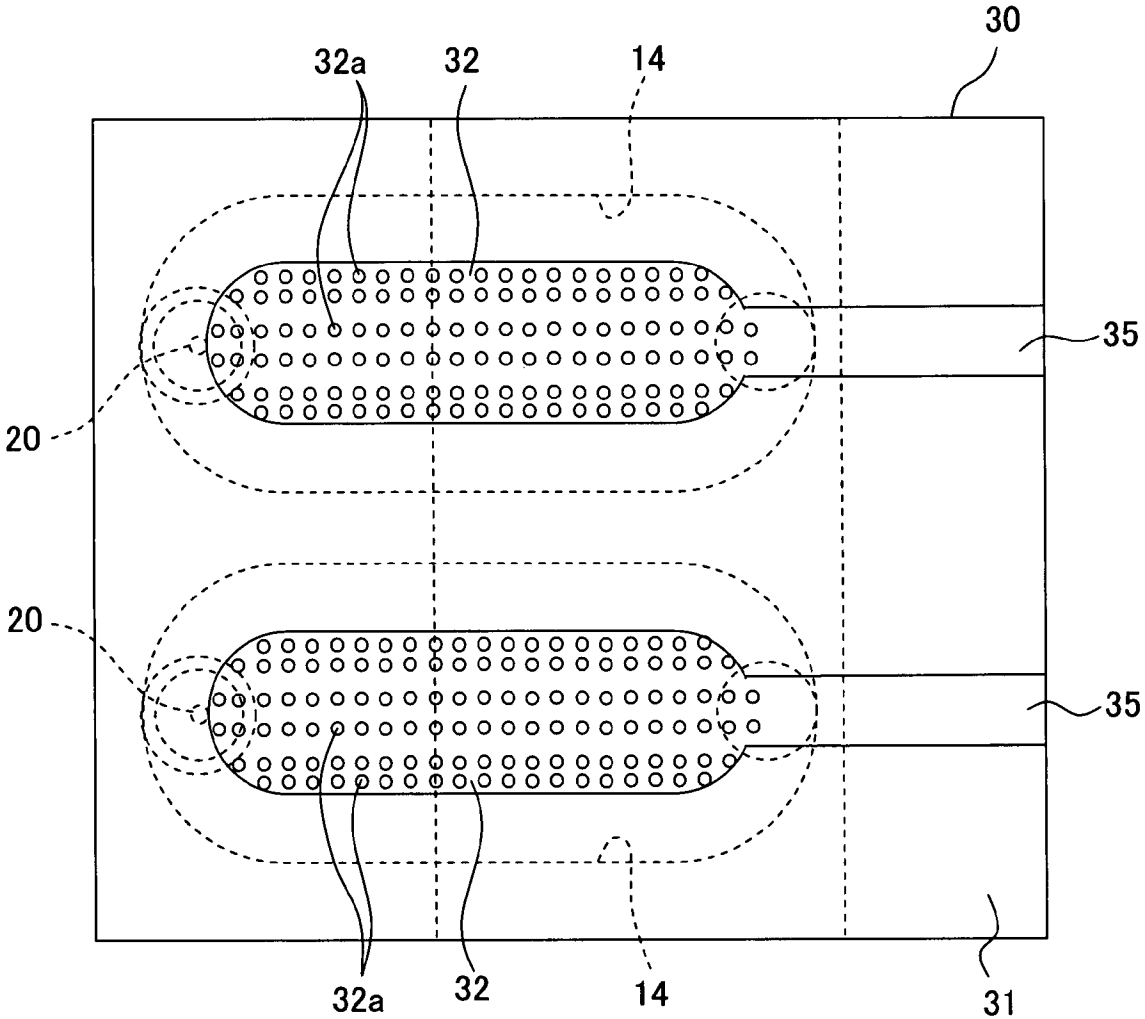
FIG. 13 is a diagram showing a modified embodiment of an actuator according to the present invention shown in FIG. 5.

In general, as the position is nearer to the outer peripheral portion of the individual electrode 32, the interface stress becomes greater between the individual electrode 32 and the piezoelectric layer 33. Therefore, the piezoelectric layer 33 tends to easily exfoliate from the outer peripheral side of the individual electrode 32. In order to deal with this, as shown in FIG. 13, the density of allocation of the through holes 32*a* in the outer peripheral portion is made to be greater to improve and the adhesion between the piezoelectric layer 33 and the individual electrode 32 in the outer peripheral portion. This enables to prevent more assuredly the piezoelectric layer 33 from exfoliating from the individual electrode 32.

Second Modified Embodiment

Figure 14:
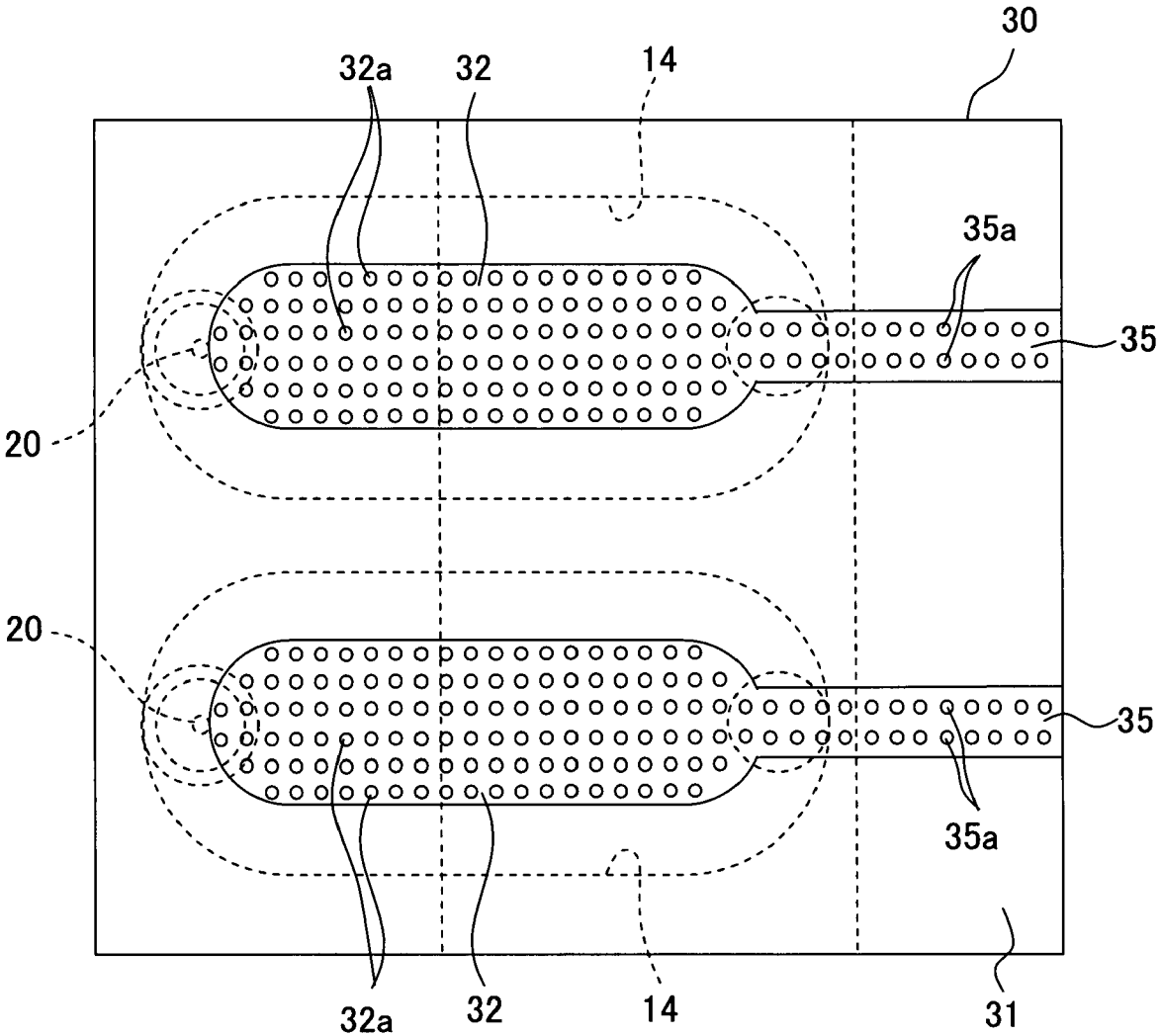
FIG. 14 is a diagram showing a modified embodiment of the actuator according to the present invention shown in FIG. 5.

As shown in FIG. 14, while forming the plurality of through holes 32*a* in the individual electrode 32, a plurality of through holes 35*a* may be formed also in the wire 35 which extends from the individual electrode 32 in order to further improve the adhesion among the piezoelectric layer 33, and the individual electrode 32 and the wire 35.

Third Modified Embodiment

Figure 15:
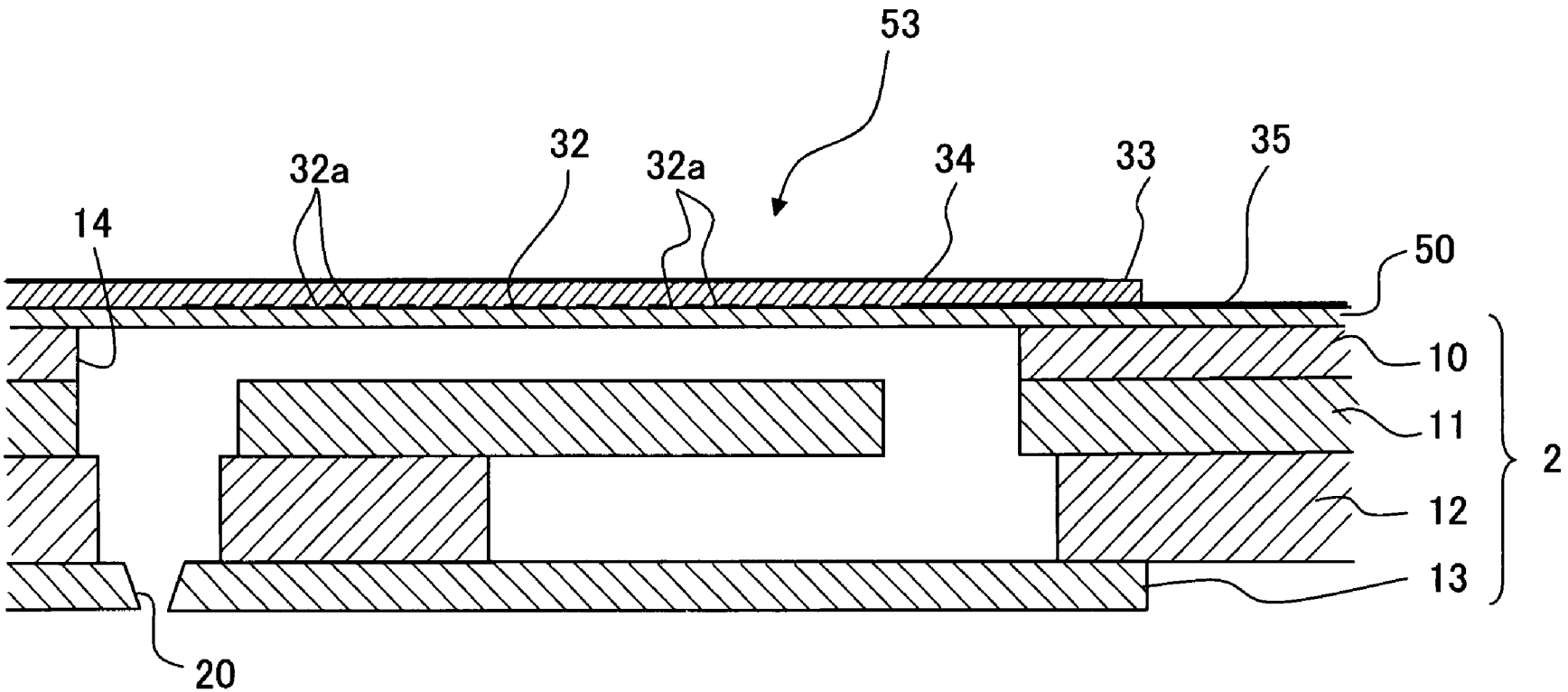
FIG. 15 is a diagram showing a modified embodiment of the ink-jet head according to the present invention shown in FIG. 3.

According to the embodiment of the method of manufacturing piezoelectric actuator, the insulating layer 31 is formed on the surface of the metallic vibration plate 30 and further the plurality of individual electrodes 32 is formed on the surface of the insulating layer 31. However, as shown in FIG. 15, the plurality of individual electrodes 32 may be formed directly on a surface of a vibration plate 50 (corresponds to the insulating layer according to the present invention) which is formed of an insulating material, and the plurality of through holes 32*a* may further be formed on each individual electrode 32. In a piezoelectric actuator 53 manufactured in this manner, the part of the piezoelectric layer 33 which is formed on the surface of the individual electrode 32 is adhered closely to the vibration plate 50 via the plurality of through holes 32*a*. To make the piezoelectric actuator 53 highly responsive, it is desirable that the insulating material which forms the vibration plate 50 is a material having a high coefficient of elasticity such as a ceramic material like alumina, zirconia or a glass material like boro-silicated glass.

Fourth Modified Embodiment

According to the embodiments described above, the individual electrodes 32 are formed on the surface of the insulating layer 31 (under surface of the piezoelectric layer 33) and the common electrode 34 is formed on the surface of the piezoelectric layer 33. However, the common electrode 34 may be formed on the surface of the insulating layer 31 and the individual electrodes 32 may be formed on the surface of the piezoelectric layer 33. In this case, a plurality of through holes is to be formed on the common electrode 34 to improve the adhesion with the piezoelectric layer 33.

Fifth Modified Embodiment

Figure 16A:
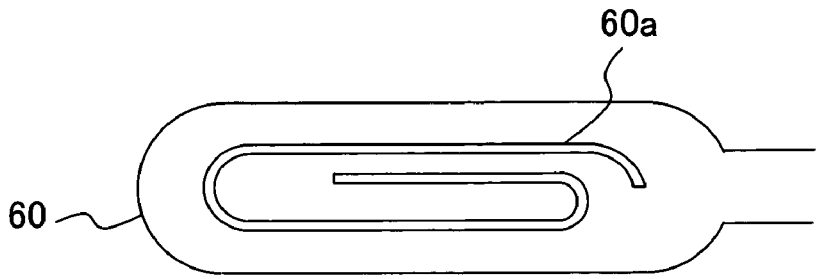
FIGS. 16A to 16D are conceptual diagrams showing other patterns of the through hole of the individual electrode.
Figure 16B:
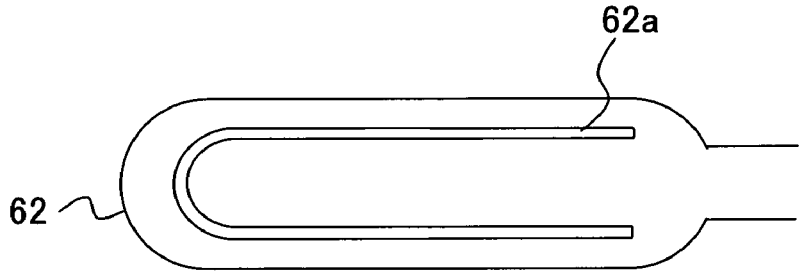
Figure 16C:
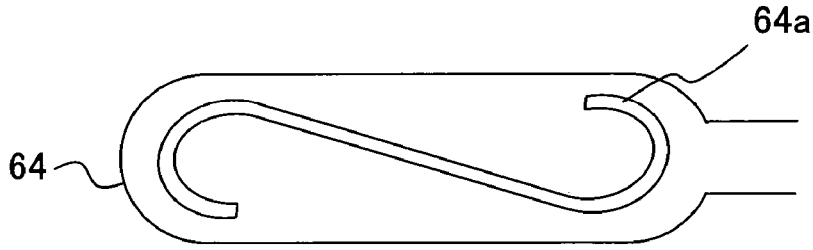
Figure 16D:
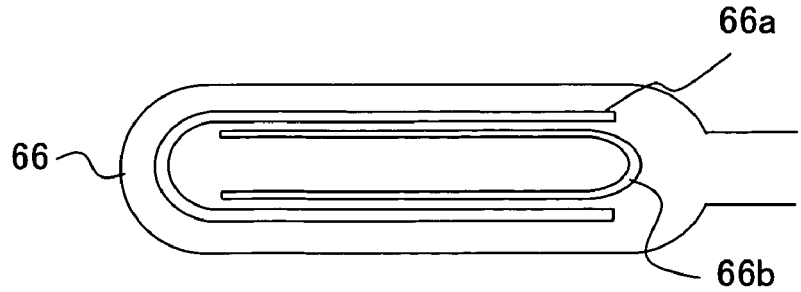

According to the embodiment described above, the plurality of through holes is formed on each of the individual electrodes 32. However, only one through hole may be formed on each of the individual electrodes as shown conceptually in FIG. 16A to FIG. 16D. In FIG. 16A, a groove having a spiral shape is formed on an individual electrode 60. Or, as shown in FIG. 16C, the through hole may be a S-shaped groove 64*a* formed on an individual electrode 64. The groove may be formed to have arbitrary shape. Considering a fact that the layer tends to exfoliate easily in the outer peripheral portion of the individual electrode than in the central portion, the through hole may be a U-shaped groove or a groove having a shape close to a ring which is formed only along an area near to the outer periphery of the individual electrode 62, as shown in FIG. 16B. Further, a plurality of grooves 66*a* and 66*b* may be provided on the individual electrode 66, as shown in FIG. 16D.

Sixth Modified Embodiment

Figure 17B:
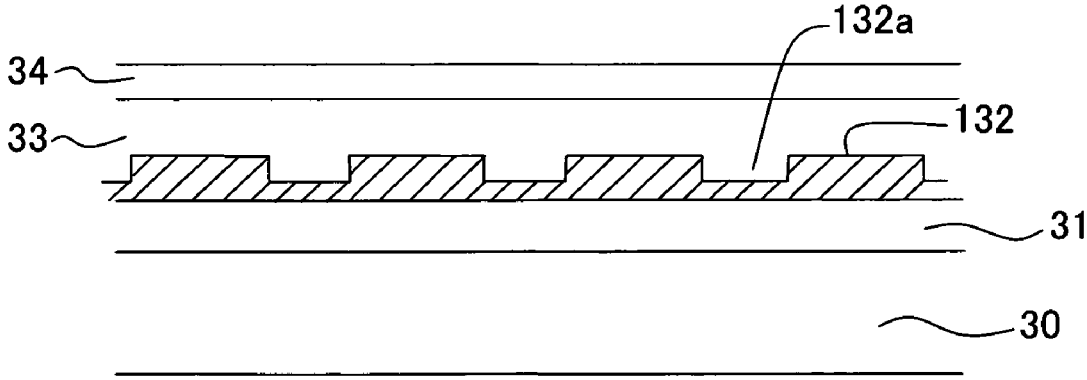
FIG. 17B is an enlarged cross-sectional view showing a modification 5 according to the present invention.

According to the embodiments described above, the plurality of through holes is formed in each of the individual electrodes 32. However, as shown in FIG. 17B, recesses 132*a* may be provided on a surface of an individual electrode 132 on a side of the piezoelectric layer 33. The individual electrode 132 which has the recesses 132*a* may be formed by a method such as plating method, sputtering method, and vapor deposition method. It is desirable that the diameter of the recess 132*a*, similar to that of the through hole, is greater than the thickness of the individual electrode 132 and smaller than the thickness of the piezoelectric layer 33. The depth of the recess 132*a* may be selected appropriately upon considering the exfoliation-resistant property of the piezoelectric layer 33 from the individual electrode 132. For example, when the recesses 132*a* are provided on the central portion and the outer peripheral portion of the individual electrode 132, the recess 132*a* on the outer peripheral portion may be deeper than the recess 132*a* on the central portion. In this case, a portion which is defined between the two recesses 132*a* formed on the individual electrode 132 can be viewed as a projection. In other words, when the individual electrode 132 is provided with projections which project or protrude from its surface, a recess is formed in a portion sandwiched between the two projections. Therefore, a case in which the projections are formed is considered to be also included in the present invention. The planar shape of the recess 132*a* (or projection) is not restricted to the circular shape and may be a rectangular shape or various shapes. Moreover, only one recess 132*a* may be formed on the individual electrode 132 as shown in the fifth modified embodiment.

The invention claimed is:

1. A piezoelectric actuator comprising: an insulating layer; a first electrode which has a recess formed within a surface of the first electrode and which is provided on the insulating layer, the recess being a through hole which penetrates the first electrode; a piezoelectric layer which is formed on the surface of the first electrode; and a second electrode which is formed on a surface of the piezoelectric layer, wherein a part of the piezoelectric layer exists inside an inner surface of the through hole.

2. The piezoelectric actuator according to claim 1, wherein the through hole includes a plurality of holes.

3. The piezoelectric actuator according to claim 2, wherein the holes are formed respectively in an outer peripheral portion and a central portion of the first electrode and a density of allocation of the holes in the outer peripheral portion is greater than a density of allocation of the holes in the central portion.

4. The piezoelectric actuator according to claim 1, wherein the insulating layer is formed of a material which has a coefficient of thermal expansion closer to a coefficient of thermal expansion of the piezoelectric layer than to a coefficient of thermal expansion of the first electrode, and the piezoelectric layer is adhered tightly to the insulating layer via the through hole.

5. The piezoelectric actuator according to claim 1, wherein a diameter of the through hole is greater than a thickness of the first electrode.

6. The piezoelectric actuator according to claim 1, wherein a diameter of the through hole is smaller than a thickness of the piezoelectric layer.

7. An ink-jet head comprising: nozzles which discharge ink; a channel unit which has a plurality of pressure chambers communicating with the nozzles, respectively; and a piezoelectric actuator which selectively changes a volume of the plurality of pressure chambers, wherein the piezoelectric actuator includes: an insulating layer; a plurality of individual electrodes provided on the insulating layer corresponding to the plurality of pressure chambers, respectively, each of the individual electrodes being provided with a recess within a surface thereof, the recess being a through hole which penetrates each of the individual electrodes; a piezoelectric layer provided on surfaces of the plurality of individual electrodes; and a common electrode provided on the piezoelectric layer, wherein a part of the piezoelectric layer exists inside an inner surface of the through hole.

8. The ink-jet head according to claim 7, wherein the through hole includes a plurality of holes.

9. The ink-jet head according to claim 8, wherein the holes are formed respectively in an outer peripheral portion and a central portion of each of the individual electrodes and a density of allocation of the holes in the outer peripheral portion is greater than a density of allocation of the holes in the central portion.

10. The ink-jet head according to claim 7, wherein the insulating layer is formed of a material which has a coefficient of thermal expansion closer to a coefficient of thermal expansion of the piezoelectric layer than to a coefficient of thermal expansion of the individual electrodes, and the piezoelectric layer is tightly and partially adhered to the insulating layer via the through hole.

11. The ink-jet head according to claim 7, wherein a diameter of the through hole is greater than a thickness of each of the individual electrodes.

12. The ink-jet head according to claim 7, wherein a diameter of the through hole is smaller than a thickness of the piezoelectric layer.

* * * * *

UNITED STATES PATENT AND TRADEMARK OFFICE

CERTIFICATE OF CORRECTION

PATENT NO. : 7,591,542 B2
APPLICATION NO. : 11/143753
DATED : September 22, 2009
INVENTOR(S) : Hiroto Sugahara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 689 days.

Signed and Sealed this

Fourteenth Day of December, 2010

David J. Kappos

David J. Kappos
*Director of the United States Patent and Trademark Office*